United States Patent [19]

Donaldson

[11] Patent Number: 4,998,312

[45] Date of Patent: Mar. 12, 1991

[54] TOOL FOR FORM STAKE REMOVAL

[76] Inventor: Andrew H. Donaldson, 2724 Bonnie Dr., Santa Clara, Calif. 95051

[21] Appl. No.: 419,906

[22] Filed: Oct. 11, 1989

[51] Int. Cl.[5] ..... B25F 1/00

[52] U.S. Cl. ..... 7/166; 7/169; 7/170; 254/131; 254/132; 29/267

[58] Field of Search ..... 7/166, 169, 170, 143, 7/146, 147; 254/131, 132, 30, 18, 21, 25; 29/267

[56] References Cited

U.S. PATENT DOCUMENTS

| | | | |
|---|---|---|---|
| 2,582,284 | 1/1952 | Sarosdy | 254/132 |
| 2,784,622 | 3/1957 | Curtin | 7/146 |
| 3,867,733 | 2/1975 | Verlander | 254/132 |

FOREIGN PATENT DOCUMENTS

| | | | |
|---|---|---|---|
| 27211 | of 1909 | United Kingdom | 7/166 |

*Primary Examiner*—Roscoe V. Parker
*Attorney, Agent, or Firm*—Thomas M. Freiburger

[57] ABSTRACT

A tool primarily for pulling stakes from concrete forms includes a relatively long lever arm and a bore for encircling a metal stake, oriented generally at right angles to the lever arm. In preferred embodiments, the bore has a relatively sharp edge and gripping teeth for positive gripping engagement against the rod to enable twisting of the stake and subsequent lifting of the stake. The tool also includes, in preferred embodiments, a protruding fulcrum end to allow prying the stake up using the stationary wooden form for engagement by the fulcrum point. A further preferred feature is a chisel edge on the fulcrum end, to enable the tool to be used for form stripping. The chisel end may further include an opening configured for nail pulling. Thus, in a preferred embodiment the tool can be used for nail removal from forms, for stake twisting and pulling, for stripping of forms from concrete and also for bending of reinforcing bar to a substantially accurate, consistent bend angle. One preferred but optionally further feature is that the long lever is hollow through most of its length, enabling it to be used for straightening stakes that have been bent in the driving or removal process.

12 Claims, 3 Drawing Sheets

TOOL FOR FORM STAKE REMOVAL

BACKGROUND OF THE INVENTION

The invention relates to construction tools generally, and in particular the invention is concerned with a stake pulling device for facilitating the removal of stakes used in concrete form work.

In concrete construction, such as the pouring of foundations, walls, decks and other concrete structures, wooden forms are typically used to define the edges of the concrete structure and to provide smooth wall exteriors and sharp transition lines between concrete areas. Generally, but not always, vertical forms are held in place for the pour by metal form stakes driven into the ground or sometimes into wooden timbers, positioned at the outer side of the wooden form in order to bear the outward load which will be exerted by the poured, wet concrete.

The driven concrete stakes are often difficult to remove, for any of several reasons. They may be very tightly held in the ground or in a wooden timber; the side load pressure of the form makes them more difficult to pull; and in most cases, a part of the length of the stake, just above the ground, is actually surrounded by poured overburden concrete which may have partially set when the stake is to be removed. If the stake is not removed at an opportune time, it can be cemented very tightly into several inches of set concrete, making removal extremely difficult.

Previous to the present invention, other types of form stake pullers have been known. One previous stake removal device has been distributed by Dee Concrete Accessories Company of Chicago Ill., and is shown in that company's catalogue dated June 1984 at page 206. That stake removal device had a double A-frame stand several feet tall, supporting a fulcrum and lever designed to exert an upward pulling force on a form stake via a clamp which was to be engaged on the stake.

No previous form stake puller or stake removal method has been as efficient and effective in use and as versatile for multiple purposes in association with concrete form work, as the present invention described below.

SUMMARY OF THE INVENTION

In accordance with the present invention, a stake pulling device and method involve an elongated rod serving as a lever arm. At a forward end of the rod is a bore head or forward end member having a generally vertical bore, i.e. generally at a right angle to the length of the rod, and of a diameter sufficient to be slipped over a metal form stake. The bore diameter is sufficient to accommodate any "mushrooming" at the top of the stake which has been caused by driving.

The stake-engaging bore at the forward end of the device has sharply defined edges at its upper and lower end, at positions where the bore will engage a stake when the lever arm is pulled upwardly. Non-engaging areas of the bore need not have such a sharp edge and in fact are preferably formed in an oversized configuration so as to help facilitate the slipping of the bore over the stake. The sharply defined edges positively grip the stake and tend to bite into the metal of the cylindrical stake, so that the tool does not slip when it is used to pull the stake upwardly or to rotate the stake. In one preferred embodiment, one or more teeth are formed in the sharply defined edges, to further facilitate a biting engagement with the stake and a positive gripping of the stake by the tool. The bore edges and the teeth enable a user to rotate the stake to break it loose before attempting to pull the stake upward.

In preferred embodiments the tool has an extending fulcrum end, integral with and extending forward from the head portion which has the bore. The protruding fulcrum end is structurally shaped and designed so as to enable the tool to rest on and form a fulcrum point on the top edge of a wooden form, while engaging the adjacent stake with the bore, so that a very large leverage and lifting force can be exerted on the stake to break it loose from its position.

The forward extension of the tool also includes, in one preferred embodiment, a chisel end or forward tip which tapers down in thickness somewhat in the manner of a blunt chisel. This enables the tool to be used for form stripping after the stakes have been removed, that is, to wedge between the wooden form and the set concrete to remove the form.

Still another preferred feature which may be included in a preferred embodiment of the tool of the invention is a nail-pulling slot formed in the forward chisel end or fulcrum extension of the tool. The nail-pulling slot can be a tapered opening through the fulcrum extension, in a position to engage over nail heads in the wooden forms and to remove them from the forms with a great deal of leverage when needed.

The shape of the fulcrum extension or chisel end of the stake pulling tool of the invention is important in assuring that the tool can be used for the purposes described above. The fulcrum extension preferably has a connecting portion angling upwardly and forwardly from the head portion, and a generally horizontal fulcrum lip or flange extending further forward from the connecting portion. This effectively places the chisel end generally in a separate and elevated horizontal plane as compared to the location of the elongated rod member.

The fulcrum extension helps enable the tool to be used to engage a stake in a positive gripping position while the fulcrum end is appropriately positioned on top of the form for leverage. It also positions the fulcrum end, when it includes the chisel feature, at a proper position for use of the tool in stripping forms. Still further, it places the nail pulling slot, when this feature is included, in a proper position to engage nails for removal, without interference of the head or bore section against the wooden form.

Another feature preferably included in the device of the invention is that the elongated rod member is hollow through at least some of its length, with an opening at the rearward end of the tool. The rod can thus be used to slip over stakes which have been bent during driving, and to straighten them before fully removing them.

A related purpose of the tool of the invention is the accurate bending of reinforcing bars at the job site. The head or bore section of the tool can be placed over a reinforcing bar, with the bar appropriately held at one end, and an accurate 90 bend, for example, can be made due to the configuration of the bore and the leverage achievable with the elongated rod of the tool.

It is therefore among the objects of the present invention to provide an improved stake pulling tool for removing stakes used in concrete form work, even after hydration has begun in overburden concrete surrounding the bottom end of the stake. A related object is to provide a multiple purpose tool which can be used for pulling form nails, stripping the form from the concrete after the stakes have been removed, straightening bent form stakes and achieving accurate bends in reinforcing bars. These and other objects, advantages and features of the invention will be apparent from the following description of preferred embodiments, considered along with the accompanying drawings.

DESCRIPTION OF PREFERRED EMBODIMENTS

Figure 1:
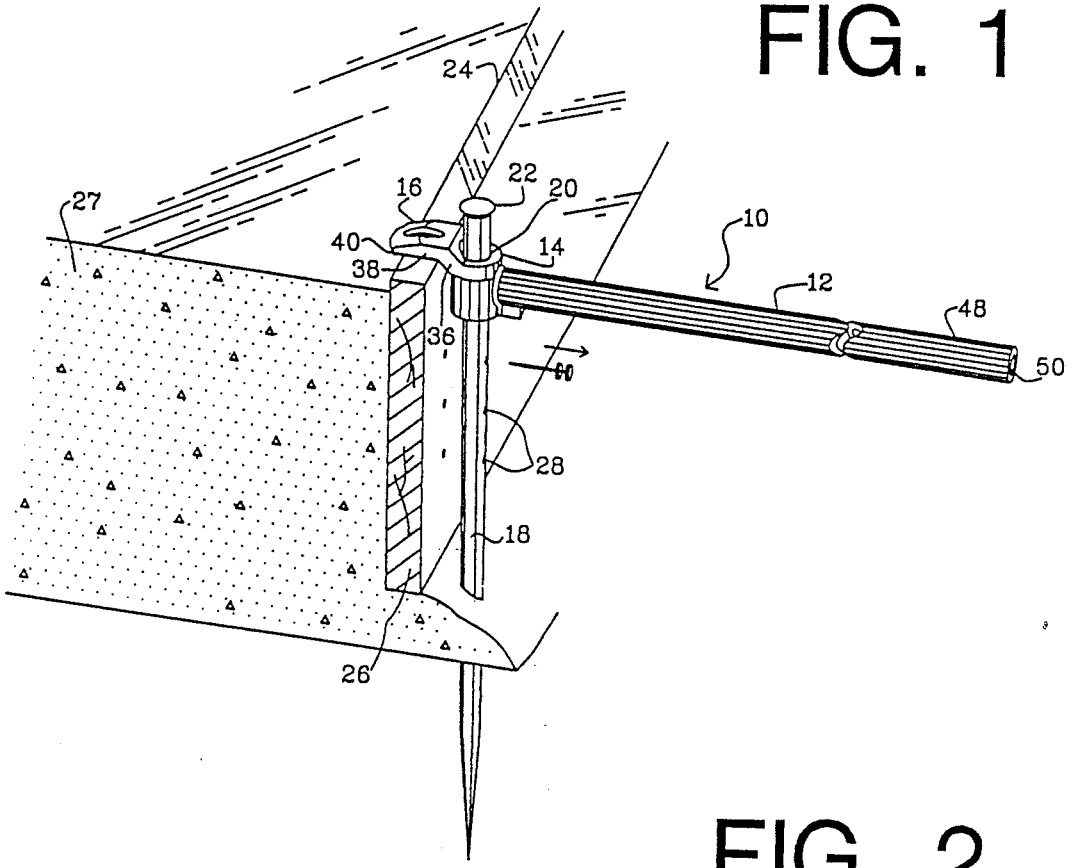
FIG. 1 is a perspective view showing a stake pulling tool in accordance with the invention, as used for removing a form stake.

In the drawings, FIG. 1 shows a stake pulling tool 10 in accordance with the principles of the present invention. The stake pulling tool 10 includes and elongated rod 12 serving as a lever arm, a bore head or stake engaging head member 14 at a forward end of the rod, and a fulcrum end forward of the head member, generally identified by the reference number 16. The tool is shown engaged over a form stake 18, with a bore 20 in engagement with the stake. The bore 20 is essentially at right angles to the length of the rod 12, is of a sufficiently large effective diameter to slip over a standard form stake (form stakes are generally $\frac{3}{4}$ inch in diameter), and including accommodating any "mushrooming" 22 which might have occurred at the top of the stake due to repeated driving of the stake, which can increase diameter at the head of the stake to 1"+.

As also shown in FIG. 1, the fulcrum extension 16 of the tool 10 may be engaged against the top edge 24 of a form 26 which forms a vertical wall for poured concrete 27. This enables the stake 18 to be pulled upwardly with considerable leverage, and with the engagement between the fulcrum extension and the form edge 24 serving as a fulcrum for pulling the stake.

FIG. 1 also shows a series of nailing bores 28 which are generally included in a form stake 18. In setting up a form 26, against a series of stakes such as the stake 18, these bores 28 are used to secure the form to the stake with nails.

Figure 2:
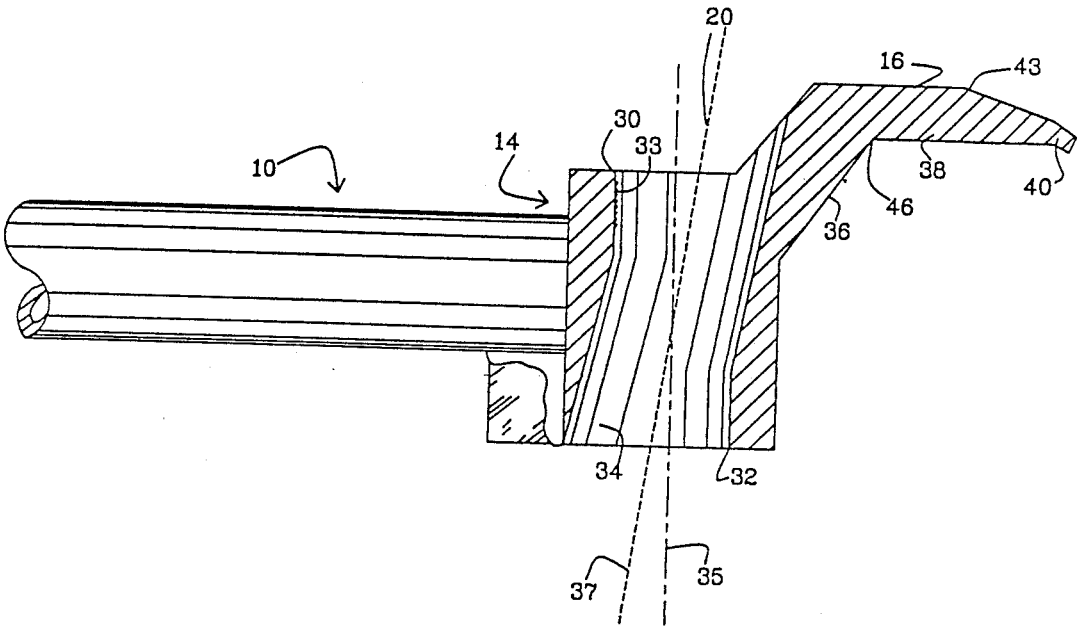
FIG. 2 is a sectional view of a portion of the stake removing tool.

FIG. 2 shows a preferred configuration of the tool head, particularly of the bore head 14 and the fulcrum extension 16, in greater detail. The bore 20 preferably has sharply defined edges at 30 and 32, so that it tends to positively grip and bite into the metal of the form stake 18 somewhat when the tool is tipped upwardly to a lifting position in engagement with the stake 18, as shown in the drawings. The upper, rear edge 30 of the bore and the lower, forward edge 32 of the bore are thus sharply defined for engagement with the stake 18, and may include one or more serrations or teeth 33 which further assist in biting into the stake for positive, secure gripping. The oversized bore 20 preferably has flared out or rounded areas 34 at a forward, upper edge and a rearward, lower edge as shown, since these edges will not be used to engage the stake for lifting or twisting, and the increased effective diameter in these areas is essential in slipping the tool over the stake. It is an important feature of the tool that the bore be essentially matched to the stake's diameter for best gripping and rotation, while also facilitating slipping the tool over a worked, mushroomed head. The flare-outs or angular counterbore shown in FIG. 2, overlapping on both sides as shown, achieves this versatility. As shown in FIG. 2, the flared areas may be formed by an angular counterbore of about $\frac{7}{8}$" to $1\frac{1}{8}$" diameter (preferably about 1 inch) and at an angles of about 18° to 23° (preferably about 20°) from the axis 35 of the substantially vertical bore 20. The axis of the counterbore is indicated at 37. In a preferred embodiment, the substantially vertical bore 20 about the axis 35 extends about one-fourth of the axial depth of the bore 20 at both the upper, rear area and the lower, forward area before it is interrupted by the angled counterbore, as the bore is viewed in a bisecting cross section as in FIG. 2. As is clear from FIG. 2, this enables an oversized, mushroomed stake head, larger than the bore 20 diameter (which probably matches the stakes outer diameter), to be inserted through the head 14.

FIGS. 1 and 2 also show that the fulcrum extension 16 of the tool 10 preferably is configured to include an upwardly, forwardly angled gusseted connecting portion 36 and a generally horizontal fulcrum lip or flange 38 extending further forward from the connecting portion 36. This effectively places the fulcrum lip or flange 38 in a separate and elevated horizontal plane as compared to the location of the elongated rod member 12, as illustrated. As can be seen from FIG. 1, this is helpful for achieving a proper positioning of the bore 20 about the stake 18 while the fulcrum lip or flange 38 is properly positioned to bear down against the upper edge 24 of the form.

Although the tool 10 is shown in FIG. 1 using the fulcrum extension 16 for best leverage, the tool is effective to pull and remove stakes without engaging the fulcrum extension with the top of the form, in application on a free-standing stake. The stake can easily be rotated using the tool, in a situation of tight engagement. With the tool used against a form 26 as in FIG. 1, it can be operated with one hand; when used on a free-standing stake the tool is operated with two hands on the rod 12, one near the head and one toward the rearward end.

Figure 3:
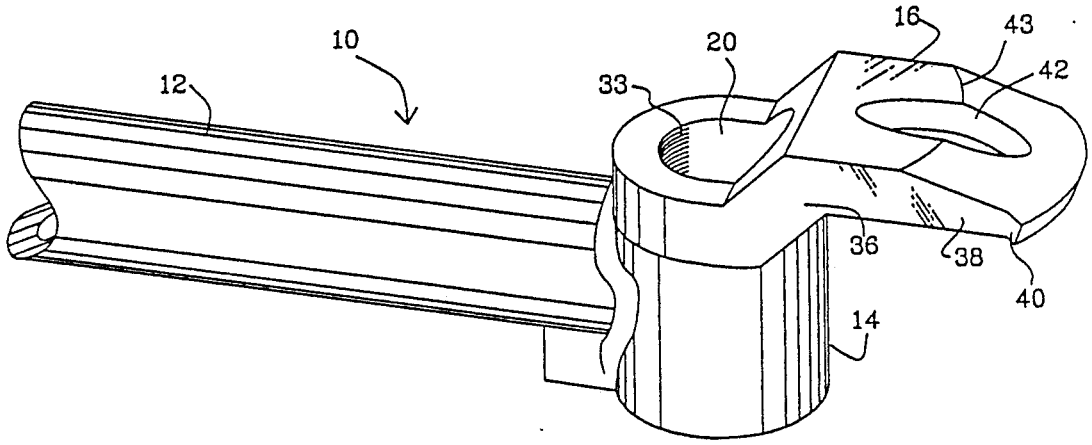
FIG. 3 is a perspective view showing preferred features of the tool, particularly of a bore section and fulcrum extension of the tool.

As shown in FIGS. 2 and 3, the fulcrum extension 16 of the tool may also be configured to serve several other purposes. The fulcrum lip or flange 38 preferably is tapered to a chisel end, with a narrowed forward edge 40 to act as a blunt chisel end. This enables the tool to be used for stripping of forms 26 away from poured, set concrete 27. Thus, it is seen that the upward extension of the chisel end or fulcrum lip 38, i.e. in a plane elevated above that of the rod 12, can be important in enabling an efficient use of the tool for the form stripping function.

Figure 4:
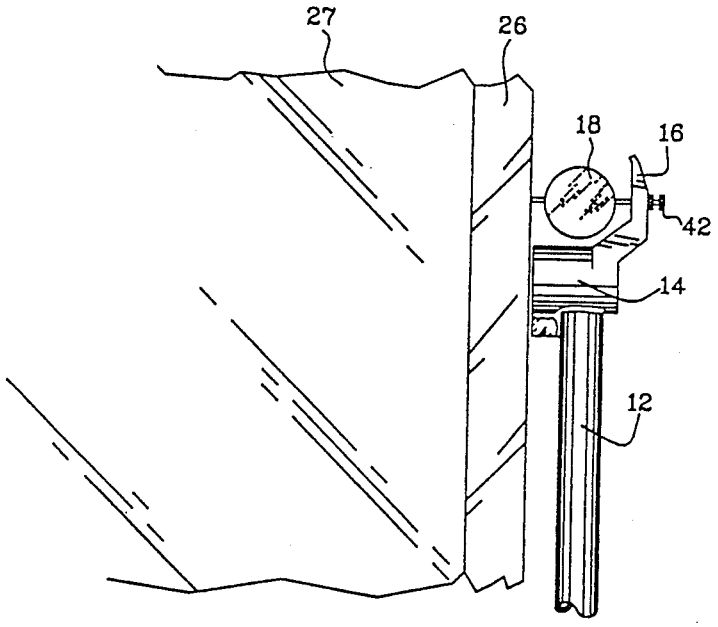
FIG. 4 is a plan view showing the device as used for pulling nails from forms.

Further, FIG. 3 shows that the chisel end or fulcrum extension 38 may include a nail puller slot 42, in a typical tapered shape, for slipping over the heads of nails and removing them from the form prior to pulling of the stakes. Thus, the nail puller 42 can be slipped over nails which hold the stake 18 to the form 26, then the shape of the tool helps in enabling the nail to be pried out from the stake and the form with considerable leverage. The nail puller slot opening 42 may flare outwardly at its upper side, as illustrated, and also at its lower side (not shown), so that nail heads can be engaged on the outer (upper as seen in the drawings) or inner (lower) side of the tool. The removal of nails is shown schematically in FIG. 4. The nail puller is bidirectional and can be used either as in FIG. 4 or flipped over so that the top or outer side of the nail puller is against the stake. In such position the tool may be oriented in any desired direction. A horizontal break or apex line 43 (between a horizontal portion and an incline leading to the chisel end 40) is positioned so as to straddle the length of the nail puller 42, as seen in FIGS. 2 and 3, aiding in the nail pulling function. Generally nails used in forms are duplex nails, so that the outer head is easily gripped. The tool is useful for all form nails, whether used in connection with form stakes or otherwise.

The dimensions of the bore head 14 and fulcrum end/chisel extension 16 are important in their relationship to the dimensions of the form stake 18 and the wooden form 26. As stated above, the most common form stake is approximately $\frac{3}{4}$ to 1 inch in diameter. The effective diameter of the bore 20, i.e. the diameter defined by the truly circular portions (excluding the flared out areas 34) preferably is about $\frac{3}{4}$ inch. This has been found to accommodate any mushrooming which has occurred from driving of a $\frac{3}{4}$ inch stake, which may have $\frac{1}{4}''+$ increased diameter due to mushrooming.

The exterior diameter of the bore head 14 may be about $1\frac{1}{2}$ to 2 inches (preferably about $1\frac{3}{4}$ inches), for a tool formed of 1.35 manganese alloy/carbon steel, heat treated. This gives a wall thickness, particularly in the critical areas 30 and 32, of about $\frac{1}{2}$ inch for adequate strength in removing the form stakes.

The elongated rod or lever arm 12, in one preferred embodiment of the invention, has an inside diameter of about 1 to $1\frac{1}{2}$ inches (preferably about $1\frac{1}{4}$ inches), with a wall thickness of about 0.10 inch, and a length of about 2 to 3 feet (preferably about $2\frac{1}{2}$ feet). Also in a preferred embodiment, the distance between the horizontal center line of the rod 12 and the lower contacting face of the lip or flange 38 is in the range of about to $1\frac{3}{4}$ inches, (preferably about $1\frac{3}{8}$ inches), with the distance from the vertical center line of the bore 20 to the nearest horizontal edge or apex 46 of the flange 38 being about $\frac{3}{4}$ to $1\frac{1}{4}$ inches, preferably about 1 inch. In such a preferred embodiment, the depth or axial length of the bore (the height of the head 14) is in the range of about $2\frac{3}{8}$ to 3 inches, preferably about $2\frac{3}{4}$ inches.

The chisel edge 40 of the tool should not be sharp; it has been found that a thickness at this edge of about $\frac{1}{8}$ inch, or in the range of about 1/16 inch to 3/16 inch, is adequate to maintain strength at the edge and is sufficiently narrow to allow the tool to be effectively used for form stripping.

Figure 5:
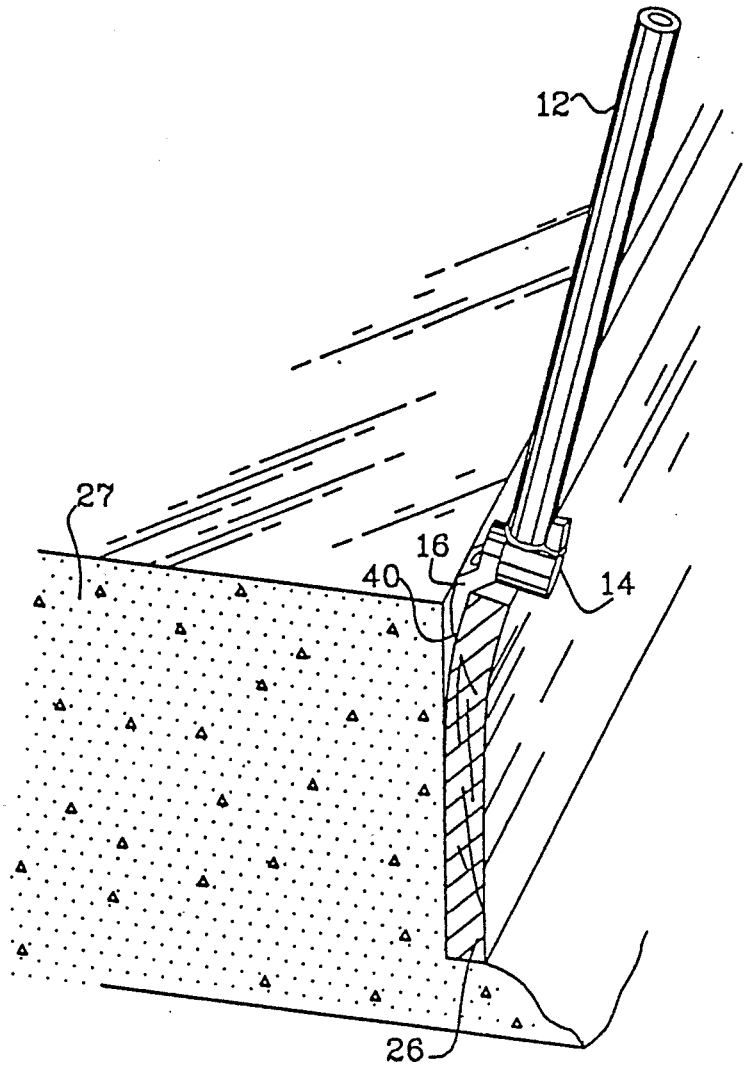
FIG. 5 is a view schematically showing the tool of the invention as used for stripping a form from set concrete.

FIG. 5 shows the tool 10 in a schematic indication of form stripping. The chisel edge 40 is jammed between a wooden form 26 and the set concrete 27 with the momentum of the tool behind it. In one preferred embodiment the tool has a weight in the range of about five to eight pounds. The tool 10 is thus used efficiently for stripping the wooden forms from the poured and set concrete, which tends to adhere somewhat to the forms.

As indicated in FIG. 1, the rearward end 48 of the tool, in one preferred embodiment, is tubular and hollow. The cylindrical cavity 50 preferably extends at least part way through the length of the elongated rod 12, and in fact the entire rod may comprise a hollow tube. As stated above, the inside diameter of the tube may be about $1\frac{1}{4}$ inches. This enables the tool 10 to be used for straightening bent form stakes. The rearward end 48 of the tool is slipped over a bent form stake down to the bend, while the stake is still at least partially retained in the ground or in concrete. The tool can then be used, with adequate leverage, to straighten the stake from the bend.

Although the preferred dimensions given above are suitable for the common $\frac{3}{4}$ inch form stake, it is to be understood that these dimensions will change if the tool is to be used with a stake of different diameter. The principles of the invention are the same, and the above dimensions are intended to be understood relative to the $\frac{3}{4}$ inch diameter stake.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A stake pulling device for removing form stakes from concrete forms, comprising, an elongated rod serving as a lever arm and having a forward end and a rearward end, a stake engaging head secured to the forward end of the elongated rod, the stake engaging head having a bore extending through the head generally at right angles to the length of the elongated rod, and of a diameter to accommodate a form stake through the bore, the bore being in a position which is fixed with respect to the elongated rod, and means associated with the bore for gripping a metal form stake when the stake is in the bore and the lever arm is pulled upwardly, so that the stake can be rotated and pulled upwardly by the stake pulling device.

2. The stake pulling device of claim 1, further including a chisel extension on the stake engaging head, extending forward from the head and having a narrowed tip or chisel edge, whereby the tool can be used for form stripping by pushing the chisel edge between a form and poured, set concrete.

3. The stake pulling device of claim 1, further including nail pulling means connected to the stake engaging head and effective to grip nail heads and enable them to be pulled using the leverage of the lever arm.

4. The stake pulling device of claim 1, wherein at least a portion of the length of the elongated rod is hollow, with an opening at the rearward end of the rod of sufficient inside diameter to be slipped over the top of a form stake, whereby the rod can be slipped over form stakes and used to straighten bends in the stakes.

5. The stake pulling device of claim 1, formed of 1.35 heat-treated manganese steel.

6. The stake pulling device of claim 1, wherein the stake engaging head includes protruding fulcrum means extending forward from the head in a position to engage a top edge of a wooden concrete form while the bore is engaged around a stake, to help lift and pry the stake loose as the elongated rod is pulled upwardly with fulcrum force bearing down on the wooden form.

7. The stake pulling device of claim 1, wherein the stake gripping means in the bore includes at least one tooth near an end of the bore, for gripping into the metal stake.

8. A tool for pulling concrete form stakes, comprising, a stake engaging head having an internal bore for slipping down over a driven form stake, the inside diameter of the bore being sufficient to accommodate the diameter of the stake and some degree of mushrooming at the top of the stake, lever means extending rearwardly from the stake engaging head, substantially at right angles to an axis of the bore, the bore being in a position which is fixed with respect to the lever means, and means associated with the bore for gripping a metal form stake when the bore is engaged over a form stake and the lever means is pulled upwardly, so that the stake can be broken loose from its driven position and pulled upwardly by the device.

9. The device of claim 8, wherein the stake engaging head includes protruding fulcrum means extending forward from the head in a position to engage a top edge of a wooden concrete form while the bore is engaged around a stake, to help lift and pry the stake loose as the elongated rod is pulled upwardly with fulcrum force bearing down on the wooden form.

10. A method for removing a metal form stake from a driven position adjacent to a concrete form, comprising, engaging over the form stake, from the top, a form stake removing tool having an elongated rod serving as a lever arm and a stake engaging head secured to the forward end of the elongated rod, with a bore extending through the stake engaging head generally at right angles to the length of the elongated rod, such that the bore is engaged around the stake, and the bore being in a position which is fixed with respect to the elongated rod, and lifting the elongated rod so as to tightly engage the bore against the metal form stake, and forcing the form stake to break loose from its position.

11. Tee method of claim 10, further including rotating the form stake by swinging the elongated rod about the form stake while lifting up on the elongated rod, to thereby break the form stake loose by rotation.

12. The method of claim 10, wherein the stake engaging head of the tool further includes a protruding fulcrum means extending forward from the head in a position to engage a top edge of a wooden concrete form adjacent to the stake while the bore is engaged around the stake, and the method including applying a lifting force to the elongated rod while the fulcrum means is engaged down against the concrete form, thereby lifting and prying the stake loose with great mechanical advantage as the elongated rod is pulled upwardly with fulcrum force bearing down on the wooden form.

* * * * *